US012680325B2

(12) United States Patent
Whittemore

(10) Patent No.: US 12,680,325 B2
(45) Date of Patent: Jul. 14, 2026

(54) SUPPORT SYSTEM

(71) Applicant: Zipwall, LLC., Arlington, MA (US)

(72) Inventor: Jeffrey P. Whittemore, Arlington, MA (US)

(73) Assignee: Zipwall, LLC, Arlington, MA (US)

( * ) Notice: Subject to any disclaimer, the term of this patent is extended or adjusted under 35 U.S.C. 154(b) by 232 days.

(21) Appl. No.: 18/570,250

(22) PCT Filed: Jun. 30, 2022

(86) PCT No.: PCT/US2022/035702

§ 371 (c)(1),
(2) Date: Dec. 14, 2023

(87) PCT Pub. No.: WO2023/278685

PCT Pub. Date: Jan. 5, 2023

(65) Prior Publication Data

US 2024/0384546 A1 Nov. 21, 2024

Related U.S. Application Data

(60) Provisional application No. 63/217,354, filed on Jul. 1, 2021.

(51) Int. Cl.
*E04G 21/24* (2006.01)
*E04G 21/30* (2006.01)

(52) U.S. Cl.
CPC ..... *E04G 21/243* (2013.01); *E04G 21/30* (2013.01)

(58) Field of Classification Search
CPC ..... E04G 21/243; E04G 21/30
See application file for complete search history.

(56) References Cited

U.S. PATENT DOCUMENTS

| | | | | |
|---|---|---|---|---|
| 642,236 | A | 1/1900 | Larimer | |
| 670,585 | A | 3/1901 | Fowler | |
| 827,000 | A | 7/1906 | Dinsmore | |
| 1,552,333 | A * | 9/1925 | Mosher | E04G 5/16 52/651.1 |

(Continued)

FOREIGN PATENT DOCUMENTS

| | | |
|---|---|---|
| BE | 1011260 | 6/1999 |
| CA | 3121808 | 6/2020 |

(Continued)

OTHER PUBLICATIONS

"Curtain-Wall", Brochure by Curtain-Wall.com, Feb. 2000.

(Continued)

*Primary Examiner* — Eret C McNichols
(74) *Attorney, Agent, or Firm* — Onello & Mello PC

(57) ABSTRACT

A partition support system comprising a first pole along a first axis, a second pole along a second axis, a first support pole along a third axis, and a second support pole along a fourth axis, wherein the third and fourth axes run transvers to the first and second axes. The first support pole has a first adapter to connect the first end of the first support pole to the first pole, and a second adapter to connect the second end of the first support pole, to the second pole. The second support pole has a first adapter to connect the first end of the second support pole to the first pole, and a second adapter to connect the second end of the second support pole to the second pole.

38 Claims, 11 Drawing Sheets

(56) References Cited

U.S. PATENT DOCUMENTS 1,705,625 A 3/1929 Mitchell
1,766,324 A 6/1930 Berner
2,219,169 A 10/1940 Alter
2,232,194 A 2/1941 Zogby
2,474,158 A 6/1949 Neely
2,487,585 A 11/1949 Pencek
2,816,769 A 12/1957 Noble
2,903,227 A 9/1959 de Kalb Key
2,942,829 A 6/1960 Stiffel
2,974,805 A 3/1961 Brossean
3,072,784 A 1/1963 Mann
3,090,826 A 5/1963 Cochran
3,118,363 A 1/1964 Burgess, Jr.
3,247,558 A 4/1966 Kaufman
3,322,381 A 5/1967 Bubb
3,327,310 A 6/1967 Bethune et al.
3,333,808 A 8/1967 Boff
3,350,120 A 10/1967 Hinrichs
3,431,585 A 3/1969 Foltz
3,433,510 A 3/1969 Hulterstrum
3,506,135 A 4/1970 Klingaman
3,529,860 A 9/1970 Jelley
3,592,434 A 7/1971 Murray
3,604,397 A 9/1971 Salerno
3,608,991 A 9/1971 Wade
3,713,643 A 1/1973 Gerstenberger
3,767,253 A 10/1973 Kluetsch
3,792,510 A 2/1974 Evett
3,822,850 A 7/1974 Elias
3,858,988 A 1/1975 Cohen
3,861,663 A 1/1975 Strickland
3,863,554 A 2/1975 Boyd
3,952,877 A 4/1976 Kindl
3,956,784 A 5/1976 Vargas
3,972,272 A 8/1976 Bagby
3,994,463 A 11/1976 Baker
4,026,079 A * 5/1977 Morris ..... E04G 25/06
182/180.1
4,077,083 A 3/1978 Siemund et al.
4,078,756 A 3/1978 Cross
4,087,006 A 5/1978 Schill
4,111,217 A 9/1978 Victor
4,115,966 A * 9/1978 DeLee ..... G09F 7/18
40/606.15
4,127,911 A 12/1978 Cupp et al.
4,139,101 A 2/1979 Towfigh
4,277,863 A 7/1981 Faneuf
4,334,461 A 6/1982 Ferguson et al.
4,379,654 A 4/1983 Rovelli
4,396,325 A 8/1983 Joice-Cavanagh
4,488,651 A 12/1984 Bishop
4,502,256 A 3/1985 Hahn
4,536,924 A 8/1985 Willoughby
4,576,354 A 3/1986 Blessing, Sr.
4,586,844 A 5/1986 Hammonds et al.
4,592,797 A 6/1986 Carlson
4,645,473 A 2/1987 Mochizuki
4,662,034 A 5/1987 Cunningham
4,708,189 A 11/1987 Ward
4,715,089 A 12/1987 Schema
4,717,107 A 1/1988 Servadio
4,770,086 A 9/1988 Gabster
4,794,974 A 1/1989 Melino
4,824,302 A 4/1989 Schultheis et al.
4,852,844 A 8/1989 Villaveces
4,874,028 A 10/1989 Lynch et al.
4,885,876 A 12/1989 Henke
4,907,835 A 3/1990 Salters
4,912,814 A 4/1990 McKenzie
4,926,522 A 5/1990 Wang
4,928,916 A 5/1990 Molloy
4,949,523 A 8/1990 Kassem
4,969,241 A 11/1990 Griffin
5,038,889 A 8/1991 Jankowski
5,040,915 A 8/1991 Stuart et al.
5,056,753 A 10/1991 Lunau et al.
5,078,348 A 1/1992 Babitchenko
5,116,012 A 5/1992 Offenhauer et al.
5,129,774 A 7/1992 Balseiro et al.
5,131,781 A 7/1992 Klein
5,170,974 A 12/1992 Ruggiero
5,240,058 A 8/1993 Ward
5,287,614 A 2/1994 Ehrlich
5,299,773 A 4/1994 Bertrand
5,301,915 A 4/1994 Bahniuk et al.
5,308,280 A 5/1994 Dotson
5,331,706 A 7/1994 Graham
5,345,989 A 9/1994 Brophy
5,375,303 A 12/1994 Shenier
5,379,491 A 1/1995 Solo
5,384,938 A 1/1995 Frederick
5,388,283 A 2/1995 Garnett
5,400,959 A 3/1995 Cone
5,404,602 A 4/1995 Kondo
5,469,607 A 11/1995 Henningsson et al.
5,497,537 A 3/1996 Robinson et al.
5,524,693 A 6/1996 Hamilton
5,529,326 A 6/1996 Hwang
5,536,229 A 7/1996 Albergo
5,542,209 A 8/1996 Sheu
5,555,607 A 9/1996 Parveris
5,558,501 A 9/1996 Wang et al.
5,584,456 A 12/1996 Stephens
5,640,826 A 6/1997 Hurilla, Jr.
5,645,272 A 7/1997 Brennan, Sr.
5,647,607 A 7/1997 Bolieau
5,649,780 A 7/1997 Schall
5,666,702 A 9/1997 Ming-Chieh
5,673,741 A 10/1997 Cairns
5,685,112 A 11/1997 Fara
5,707,032 A 1/1998 Ehrlich
5,715,620 A 2/1998 Walker
5,722,691 A 3/1998 Patel
5,803,653 A 9/1998 Zuffetti
5,832,652 A 11/1998 Bartys
5,884,424 A 3/1999 Smith
5,897,085 A 4/1999 Cronin
5,918,843 A 7/1999 Stammers
5,924,469 A 7/1999 Whittemore
5,937,488 A 8/1999 Geiger
5,940,942 A 8/1999 Fong
5,941,434 A 8/1999 Green
5,941,586 A 8/1999 Fann
5,944,464 A 8/1999 Cole, Jr.
5,979,110 A 11/1999 Tai
6,053,527 A 4/2000 Gans et al.
6,067,691 A 5/2000 Feltman
6,079,173 A 6/2000 Waalkes et al.
6,082,945 A 7/2000 Jeffries et al.
6,152,434 A 11/2000 Gluck
6,164,605 A 12/2000 Drake et al.
6,170,112 B1 1/2001 Mayfield et al.
6,209,615 B1 4/2001 Whittemore
6,237,182 B1 5/2001 Cassar
6,321,823 B1 11/2001 Whittemore
6,341,401 B1 1/2002 Lin
6,378,175 B1 4/2002 Vanderpan
6,467,741 B1 10/2002 Shih
6,474,609 B1 11/2002 Pinard
6,490,749 B1 12/2002 Morad
6,508,295 B2 1/2003 Whittemore
6,523,231 B1 2/2003 Lassiter
6,564,512 B1 5/2003 Whittemore
6,584,702 B2 7/2003 Irey
6,634,678 B2 10/2003 Mariman
6,662,488 B1 12/2003 Heimbrock et al.
6,729,358 B1 5/2004 Moffatt
6,908,250 B2 6/2005 Moffatt
6,942,004 B2 9/2005 Whittemore
6,953,076 B2 10/2005 Whittemore
7,073,758 B2 7/2006 Whittemore et al.
7,108,040 B2 9/2006 Whittemore
7,255,312 B2 8/2007 Melic
7,261,140 B2 8/2007 Whittemore

(56) References Cited

U.S. PATENT DOCUMENTS

| | | | | |
|---|---|---|---|---|
| 7,290,742 | B2 | 11/2007 | Wang | |
| 7,314,078 | B2 | 1/2008 | Melino, Jr. et al. | |
| 7,503,373 | B2 | 3/2009 | Whittemore | |
| 7,533,712 | B2 | 5/2009 | Whittemore et al. | |
| 7,658,219 | B2 | 2/2010 | Whittemore | |
| 7,670,401 | B2 | 3/2010 | Whittemore | |
| 7,717,382 | B2 | 5/2010 | Whittemore et al. | |
| 7,743,512 | B1 | 6/2010 | Whittemore | |
| 7,905,938 | B2 | 3/2011 | Whittemore | |
| 8,066,051 | B2 | 11/2011 | Whittemore | |
| 8,069,546 | B1 | 12/2011 | Whittemore | |
| 8,074,700 | B1 | 12/2011 | Melino | |
| 8,113,475 | B2 | 2/2012 | Whittemore et al. | |
| 8,137,426 | B2 | 3/2012 | Whittemore | |
| 8,349,047 | B2 | 1/2013 | Whittemore | |
| 8,366,155 | B1 | 2/2013 | Nolasco | |
| 8,371,360 | B2 | 2/2013 | Whittemore | |
| 8,591,619 | B2 | 11/2013 | Whittemore | |
| 8,627,873 | B2 | 1/2014 | Whittemore | |
| 8,641,006 | B2 | 2/2014 | Reichel | |
| 8,801,824 | B2 | 8/2014 | Whittemore | |
| 8,857,499 | B2 | 10/2014 | Whittemore | |
| 8,875,774 | B1 * | 11/2014 | Flores | E04G 21/247 52/749.1 |
| 9,062,468 | B2 | 6/2015 | Behringer | |
| 9,115,539 | B2 | 8/2015 | Whittemore | |
| 9,433,547 | B2 * | 9/2016 | Hart | A61G 7/1038 |
| 9,441,392 | B2 | 9/2016 | Whittemore | |
| 9,458,862 | B2 | 10/2016 | Whittemore | |
| D777,901 | S | 1/2017 | Whittemore | |
| 9,657,514 | B1 | 5/2017 | Whittemore | |
| 9,663,962 | B1 | 5/2017 | Whittemore | |
| 9,689,108 | B2 | 6/2017 | Hamman, Jr. et al. | |
| 9,784,287 | B2 | 10/2017 | Whittemore | |
| 10,081,955 | B2 | 9/2018 | Whittemore | |
| 10,174,514 | B2 | 1/2019 | Whittemore | |
| 10,428,539 | B2 | 10/2019 | Whittemore | |
| 10,538,930 | B2 | 1/2020 | Whittemore | |
| 10,597,882 | B2 | 3/2020 | Whittemore | |
| 10,689,865 | B2 | 6/2020 | Whittemore | |
| 10,781,597 | B2 | 9/2020 | Whittemore | |
| 10,961,730 | B2 | 3/2021 | Whittemore | |
| 10,968,649 | B1 | 4/2021 | Whittemore | |
| 11,230,091 | B2 | 1/2022 | Whittemore | |
| 11,441,323 | B2 | 9/2022 | Whittemore | |
| 11,447,968 | B2 | 9/2022 | Whittemore | |
| 11,530,542 | B2 * | 12/2022 | Whittemore | E04G 21/26 |
| 12,098,589 | B2 * | 9/2024 | Whittemore | E04G 21/243 |
| 12,188,246 | B2 * | 1/2025 | Whittemore | E04G 21/26 |
| 12,404,686 | B2 * | 9/2025 | Mikic | E04G 5/007 |
| 2001/0000834 | A1 | 5/2001 | Irey | |
| 2001/0029640 | A1 | 10/2001 | Cassar | |
| 2002/0011316 | A1 | 1/2002 | Whittemore | |
| 2002/0135182 | A1 | 9/2002 | Mariman | |
| 2003/0028988 | A1 | 2/2003 | Streutker et al. | |
| 2003/0070773 | A1 | 4/2003 | Whittemore | |
| 2003/0154588 | A1 | 8/2003 | Blacket et al. | |
| 2004/0031892 | A1 | 2/2004 | Whittemore et al. | |
| 2004/0065799 | A1 | 4/2004 | Whittemore et al. | |
| 2004/0194418 | A1 | 10/2004 | Gouley | |
| 2004/0200585 | A1 | 10/2004 | Whittemore | |
| 2005/0077015 | A1 | 4/2005 | Melino et al. | |
| 2005/0205729 | A1 | 9/2005 | Wang | |
| 2005/0247414 | A1 | 11/2005 | Whittemore | |
| 2005/0284591 | A1 | 12/2005 | Whittemore | |
| 2006/0022186 | A1 | 2/2006 | Melic | |
| 2006/0117679 | A1 | 6/2006 | Ferony | |
| 2006/0168925 | A1 | 8/2006 | Whittemore | |
| 2006/0272785 | A1 | 12/2006 | Whittemore | |
| 2007/0257170 | A1 | 11/2007 | Whittemore et al. | |
| 2008/0006374 | A1 | 1/2008 | Whittemore | |
| 2009/0071614 | A1 | 3/2009 | Whittemore | |
| 2009/0241688 | A1 | 10/2009 | Reichel | |
| 2010/0108849 | A1 | 5/2010 | Whittemore | |
| 2010/0115898 | A1 | 5/2010 | Whittemore | |
| 2010/0237209 | A1 | 9/2010 | Whittemore et al. | |
| 2010/0301000 | A1 | 12/2010 | Whittemore | |
| 2011/0068025 | A1 | 3/2011 | Whittemore | |
| 2011/0126500 | A1 | 6/2011 | Whittemore | |
| 2011/0192522 | A1 | 8/2011 | Whittemore | |
| 2012/0049034 | A1 | 3/2012 | Whittemore | |
| 2012/0148399 | A1 | 6/2012 | Whittemore | |
| 2012/0234705 | A1 | 9/2012 | Whittemore | |
| 2013/0118137 | A1 | 5/2013 | Whittemore | |
| 2013/0134279 | A1 | 5/2013 | Whittemore | |
| 2013/0284685 | A1 * | 10/2013 | Lines-Pinckney | A47H 1/022 211/105.3 |
| 2014/0047805 | A1 | 2/2014 | Whittemore | |
| 2014/0049043 | A1 | 2/2014 | Hamman, Jr. et al. | |
| 2014/0263916 | A1 | 9/2014 | Behringer | |
| 2014/0341725 | A1 | 11/2014 | Whittemore | |
| 2015/0052843 | A1 | 2/2015 | Whittemore | |
| 2016/0025110 | A1 | 1/2016 | Whittemore | |
| 2016/0356040 | A1 | 12/2016 | Whittemore | |
| 2017/0009473 | A1 | 1/2017 | Whittemore | |
| 2017/0009474 | A1 * | 1/2017 | Whittemore | E04G 21/243 |
| 2017/0020322 | A1 | 1/2017 | Whittemore | |
| 2018/0154293 | A1 | 6/2018 | Whittemore | |
| 2018/0291675 | A1 | 10/2018 | Whittemore | |
| 2019/0003193 | A1 | 1/2019 | Whittemore | |
| 2019/0186162 | A1 | 6/2019 | Whittemore | |
| 2020/0024858 | A1 | 1/2020 | Whittemore | |
| 2020/0080685 | A1 | 3/2020 | Whittemore | |
| 2020/0087935 | A1 | 3/2020 | Whittemore | |
| 2020/0109599 | A1 | 4/2020 | Whittemore | |
| 2021/0047850 | A1 | 2/2021 | Whittemore | |
| 2021/0404198 | A1 | 12/2021 | Whittemore | |
| 2022/0074523 | A1 | 3/2022 | Whittemore | |
| 2022/0081963 | A1 | 3/2022 | Whittemore | |
| 2022/0090398 | A1 | 3/2022 | Whittemore | |
| 2022/0162866 | A1 | 5/2022 | Whittemore | |
| 2023/0067682 | A1 | 3/2023 | Whittemore | |
| 2023/0358061 | A1 | 11/2023 | Whittemore | |
| 2025/0361955 | A1 | 11/2025 | Whittemore | |

FOREIGN PATENT DOCUMENTS

| | | |
|---|---|---|
| CN | 110453914 | 11/2019 |
| CN | 211058265 | 7/2020 |
| DE | 3326244 | 2/1985 |
| DE | 3918516 | 12/1990 |
| DE | 4420849 | 12/1995 |
| DE | 29605222 | 6/1996 |
| DE | 19618138 | 3/1997 |
| DE | 102007043292 | 3/2009 |
| EP | 0190913 | 8/1986 |
| EP | 0976351 | 2/2000 |
| FR | 2411282 | 7/1979 |
| GB | 1042086 | 9/1966 |
| GB | 2156894 | 10/1985 |
| GB | 2325397 | 11/1998 |
| JP | 2001503487 | 3/2001 |
| JP | 2003206640 | 7/2003 |
| JP | 4295354 | 7/2009 |
| KR | 102105915 | 4/2020 |
| WO | 8603538 | 6/1986 |
| WO | 9109556 | 7/1991 |
| WO | 9427480 | 12/1994 |
| WO | 2004011163 | 2/2004 |
| WO | 2005110047 | 11/2005 |
| WO | 2017117042 | 7/2017 |

OTHER PUBLICATIONS

"KwikPole", Brochure by KwikPole, Inc. www.kwikpole.com/setup.html (Aug. 2003).

"Mr. Long Arm", Brochure by Mr. LongArm, Inc., 2004.

"QUICKPROP", Brochure by Protecta Screen LTD, Aug. 1996.

"Snapwall Temporary Wall Support", brochure by C&S Manufacturing Inc.

MIlx Co., Ltd. "Magic Wall". http:/www1.mllx.co.jp/.

North American Marketing Representatives, Inc. "Power Pole".

(56) References Cited

OTHER PUBLICATIONS http:/www.waldmannbenches.com/power5205pole520content.htm (Nov. 2004).
"Third Hand", Brochure by FastCap, LLP, 2003.0.
Extended European Search Report dated Aug. 22, 2022 issued in European Application No. 20738465.2.
Extended European Search Report dated Oct. 20, 2022 issued in European Application No. 20739227.5.
International Search Report and Written Opinion dated Apr. 29, 2020 issued in International Application No. PCT/US2020/013282.
International Search Report and Written Opinion dated May 26, 2020 issued in International Application No. PCT/US20/13415.
Partial European Search Report dated Mar. 25, 2025 issued in European Application No. 22834210.1.
Canadian Office Action dated Nov. 19, 2024 issued in Canadian Application No. 3125230.
Canadian Office Action dated Dec. 13, 2024 issued in Canadian Application No. 3125232.
Extended European Search Report dated Jul. 8, 2025 issued in European Application No. 22834210.1.
International Search Report and Written Opinion dated Dec. 14, 2022 issued in International Application No. PCT/US2022/035702.
International Preliminary Report on Patentability dated Jan. 11, 2024 issued in International Application No. PCT/US2022/035702.
International Preliminary Report on Patentability dated Jun. 16, 2021 issued in International Application No. PCT/US2020/013282.
International Preliminary Report on Patentability dated Jun. 16, 2021 issued in International Application No. PCT/US2022/013415.

* cited by examiner

SUPPORT SYSTEM

RELATED APPLICATIONS

This application claims benefit of U.S. Provisional Application Ser. No. 63/217,354, titled "Support System", filed Jul. 1, 2021, the content of which is incorporated by reference in its entirety.

This application is related to:

U.S. Pat. No. 5,924,469, issued on Jul. 20, 1999;
U.S. Pat. No. 6,564,512, issued on May 20, 2003;
U.S. Pat. No. 7,073,758, issued on Jul. 11, 2006;
U.S. Pat. No. 7,533,712, issued on May 19, 2009;
U.S. Pat. No. 7,658,219, issued on Feb. 9, 2010;
U.S. Pat. No. 7,670,401, issued on Mar. 2, 2010;
U.S. Pat. No. 7,743,512, issued on Jun. 29, 2010;
U.S. Pat. No. 7,717,382, issued on May 18, 2010;
U.S. Pat. No. 9,115,539, issued on Aug. 25, 2015;
U.S. Design Pat. No. D777901, issued on Jan. 31, 2017;
U.S. Pat. No. 9,657,514, issued on May 23, 2017;
U.S. Pat. No. 9,663,962, issued on May 30, 2017;
U.S. Pat. No. 10,081,955, issued on Sep. 25, 2018;
U.S. Pat. No. 10,174,514, issued on Jan. 8, 2019;
U.S. Pat. No. 10,428,539, issued on Oct. 1, 2019;
U.S. Pat. No. 10,781,597, issued on Sep. 22, 2020;
U.S. patent application Ser. No. 15/822,423, filed on Nov. 27, 2017, United States Publication No. 2018-0154293, published Jun. 7, 2018;
Patent Cooperation Treaty Application Serial Number PCT/US20/013282, filed on Jan. 13, 2020, PCT Publication No. WO 2020/146862, published Jul. 16, 2020;
Patent Cooperation Treaty Application Serial Number PCT/US19/065102, filed on Dec. 6, 2019, PCT Publication No. WO 2020/118277, published Jun. 11, 2020;
Patent Cooperation Treaty Application Serial Number PCT/US20/013415, filed on Jan. 13, 2020, PCT Publication No. WO 2020/146904, published Jul. 16, 2020; and
Patent Cooperation Treaty Application Serial Number PCT/US20/031284, filed on May 4, 2020, PCT Publication No. WO 2020/223726, published Nov. 5, 2020; the content of each being incorporated herein by reference in its entirety.

BACKGROUND

Partition systems are often employed to isolate portions of a building or room, by serving as a barrier to dust, noise, light, odors, and other intrusions. In construction zones, partitions are useful for protecting a clean area from a work area, for example, protecting an area where furniture and rugs are temporarily stored from an area where wood floors are being refinished.

Workers at construction sites often use rudimentary techniques for installing partitions. Some simply nail, screw, or staple the curtain or partition material to the floor, ceiling, and abutting walls, resulting in damage to their surfaces. Other workers setting up a barrier employ tape or other adhesives which could result in paint being removed from the wall or the adhesive material being difficult to remove. The tape usually fails to stick, but, if it does stick, as the tape is removed, paint can pull off with the tape, or adhesive is left behind.

U.S. Pat. Nos. 5,924,469 and 7,658,219, incorporated herein by reference, disclose partition mount systems that address these limitations. These systems utilize a plurality of spring-biased pole mounts that secure a curtain or drape material, such as plastic, cloth, and the like, to form a temporary partition. The disclosed system is a "clean" system configured to be installed and removed without damaging or otherwise marking the ceiling, floor or walls in the construction zone. Assembly is easy and fast and can be accomplished by a single individual. In certain applications, however, a sag, or gap, may be present in the curtain along a pole next to a wall, ceiling, door frame, or other abutting surface, compromising the effectiveness of the installation.

U.S. Pat. No. 7,533,712, the content of which is incorporated herein by reference, discloses a mount system that mitigates or eliminates sag, or gaps, between an installed curtain and an abutting surface such as a wall or ceiling. The system accomplishes this in a manner that avoids permanent damage to the wall or ceiling surface. The system includes a head with an elongated body and a compressible curtain interface. A pole, for example, as described in connection with U.S. Pat. Nos. 5,924,469 and 7,658,219, may be configured to urge the head and the curtain to the abutting surface, thereby eliminating a sag, or gap in the curtain.

In some instances, the partition system may separate two regions with different air pressure. The resulting pressure gradient may adjust the position of the curtain, which may adjust the position of the pole mounts.

SUMMARY

In an aspect, a system comprises: a first pole elongated along a first axis; a second pole elongated along a second axis, the second axis being substantially parallel with the first axis; and a first support pole elongated along a third axis, the third axis being transverse to the first axis and the second axis, the first support pole comprising a first end coupled to the first pole and a second end coupled to the second pole.

In some embodiments, the first axis, the second axis, and third axis extend in a first plane.

In some embodiments, the system further comprises a first adapter, the first adapter coupled to the first end of the first support pole and the first pole.

In some embodiments, the system further comprises a second adapter, the second adapter coupled to the second end of the first support pole and the second pole.

In some embodiments, the first end of the support pole is removably coupled to the first adapter.

In some embodiments, the second end of the first support pole is removable coupled to the second adapter.

In some embodiments, the first end of the first support pole is coupled to the first adapter with a ball-and-socket joint.

In some embodiments, the second end of the first support pole is coupled to the second adapter with a ball-and-socket joint.

In some embodiments, the first end of the first support pole is rotatably coupled to the first adapter.

In some embodiments, the second end of the first support pole is rotatably coupled to the second adapter.

In some embodiments, the first adapter comprises a first sidewall and a second sidewall, the first sidewall and the second sidewall constructed and arranged to allow the first support pole to only rotate in the first plane.

In some embodiments, the second adapter comprises a first sidewall and a second sidewall, the first sidewall and the second sidewall constructed and arranged to allow the first support pole to only rotate in the first plane.

In some embodiments, the support pole comprises a compression mechanism.

In some embodiments, the support pole comprises and internal compression mechanism.

In some embodiments, the first pole is arranged between a floor and a ceiling.

In some embodiments, the first adapter comprises a friction pad constructed and arranged to create friction between the first adapter and the first pole.

In some embodiments, the second adapter comprises a friction pad constructed and arranged to create friction between the second adapter and the second pole.

In some embodiments, the friction pad comprises at least two raised regions constructed and arranged to create friction between the first adapter and the first pole.

In some embodiments, the friction pad comprises at least two raised regions constructed and arranged to create friction between the second adapter and the second pole.

In some embodiments, the first adapter comprises a hook-and-loop strap constructed and arranged to couple with the first pole.

In some embodiments, the second adapter comprises a hook-and-loop strap constructed and arranged to couple with the second pole.

In some embodiments, the first adapter comprises a clamp constructed and arranged to couple with the first pole.

In some embodiments, the second adapter comprises a clamp constructed and arranged to couple with the second pole.

In some embodiments, the system further comprises a second support pole elongated along a fourth axis, the fourth axis being transverse to the first axis and the second axis, the second support pole comprising a first end coupled to the first pole and a second end coupled to the second pole.

In some embodiments, the first axis, the second axis, third axis, and fourth axis extend in a first plane.

In some embodiments, the system further comprises a third adapter, the third adapter coupled to the first end of the second support pole and the first pole.

In some embodiments, the system further comprises a fourth adapter, the fourth adapter coupled to the second end of the second support pole and the second pole.

In some embodiments, the first support pole is extendable.

In some embodiments, the second support pole is extendable.

In some embodiments, the first adapter comprises an open region.

In some embodiments, the first adapter extends around a portion of the first pole.

In another aspect, an adapter comprises: a curved base extending along a first axis, the curved base comprising an upper surface and a lower surface; the curved base constructed to extend around at least a portion of a pole, at least one sidewall extending from the upper surface and extending parallel to the first axis; at least one socket coupled to the upper surface, the at least one socket constructed and arranged to mate with a corresponding connector to form a ball-and-socket joint; and a friction pad coupled to the lower surface, the friction pad constructed and arranged to create friction between the adapter and a pole.

In some embodiments, the friction pad comprises at least two raised regions constructed and arranged to create friction between the adapter and the pole.

In some embodiments, the at least one sidewall comprises a first sidewall and a second sidewall, the first sidewall and the second sidewall being spaced apart from each other.

In some embodiments, the at least one socket is positioned between the first sidewall and the second sidewall.

In another aspect, a method comprises: providing a first pole elongated along a first axis; providing a second pole elongated along a second axis, the second axis being substantially parallel with the first axis; providing a first support pole elongated along a third axis, the third axis being transverse to the first axis and the second axis; and coupling a first end of the first support pole to the first pole; and coupling a second end of the first support pole to the second pole.

BRIEF DESCRIPTION OF THE DRAWINGS

The foregoing and other features and advantages of the inventive concepts will be apparent from the more particular description of embodiments of the inventive concepts, as illustrated in the accompanying drawings in which like reference characters refer to the same parts throughout the different views. The drawings are not necessarily to scale, emphasis instead being placed upon illustrating the principles of the inventive concepts.

DETAILED DESCRIPTION OF EMBODIMENTS

Figure 1:
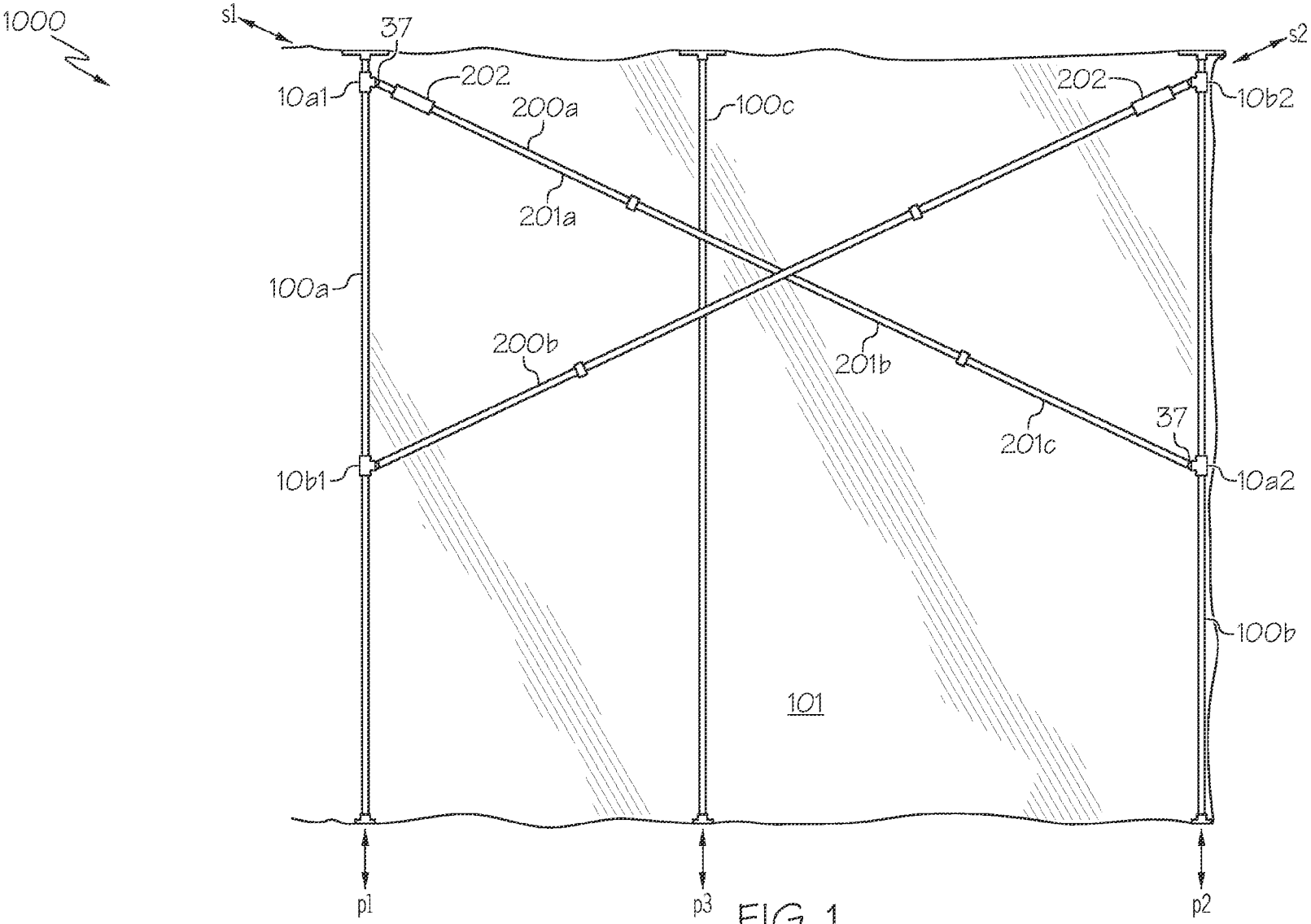
FIG. 1 is a front view of an embodiment of a support system, in accordance with aspects of inventive concepts herein.

Various example embodiments will be described more fully hereinafter with reference to the accompanying drawings, in which some example embodiments are shown. The present inventive concepts may, however, be embodied in many different forms and should not be construed as limited to the example embodiments set forth herein.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive concepts.

Spatially relative terms, such as "beneath," "below," "lower," "above," "upper" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly. A first element may be said to be "transverse" to a second element if the first element has a direction of extension that is not parallel to the direction of extension of the second element.

The terminology used herein is for the purpose of describing particular example embodiments only and is not intended to be limiting of the present inventive concepts. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in such shapes.

The embodiments described herein describe a support system that is constructed and arranged to secure the position of at least one pole in a partition mount system.

FIG. 1 is a front view of an embodiment of a support system 1000, in accordance with aspects of inventive concepts herein. In some embodiments, such as the one shown FIG. 1, the system 1000 comprises a first pole 100*a* elongated along a first pole axis p1 and a second pole 100*b* elongated along a second pole axis p2. In some embodiments, the second pole axis p2 can be substantially parallel with the first pole axis p1. In other embodiments, the first and second pole axes p1, p2 are other than parallel. In some embodiments, such as the one shown in FIG. 1, the system 1000 comprises a first support pole 200*a* elongated along a first support axis s1, the first support axis s1 being transverse to the first pole axis p1 and the second pole axis p2, the first support pole 200*a* comprising a first end coupled to the first pole 100*a* and a second end coupled to the second pole 100*b*. In some embodiments, such as the one shown in FIG. 1, the system 1000 comprises a second support pole 200*b* elongated along a second support axis s2, the second support axis s2 being transverse to the first pole axis p1 and the second pole axis p2, the second support pole 200*b* comprising a first end coupled to the first pole 100*a* and a second end coupled to the second pole 100*b*.

In some embodiments, the first pole 100*a* and second pole 100*b* comprise curtain poles constructed and arranged to support a curtain 101 or sheet of material. In some embodiments, the curtain poles can be adjustable in length, for example including multiple telescoping components. In some embodiments the curtain poles can include a compression mechanism that outwardly biases a first end of the curtain pole relative to a second end of the curtain pole. In some embodiments, a first end of the curtain pole includes a curtain clip for securing a curtain to a top of the curtain pole.

In the embodiment shown in FIG. 1 the system 1000 further comprises a third pole 100*c* elongated along a third pole axis p3. In the embodiment shown in FIG. 1, the first pole 100*a*, the second pole 100*b*, and the third pole 100*c* are arranged between a floor and a ceiling of a room. In some embodiments, the third pole 100*c* can comprise a curtain pole constructed and arranged in a manner similar to the first and second curtain poles 100*a*, 100*b*. In alternative embodiments, the one or more poles are not arranged between the floor and the ceiling of a room, but instead are arranged between other structures.

In some embodiments, the support pole, for example, the first and second support poles 200*a*, 200*b* comprises a pole that is adjustable in length. In some embodiments, the first support pole 200*a* includes multiple telescoping segments 201*a, b, c* with twist-lock cam mechanisms for locking their respective positions. In some embodiments the first support pole 200*a* includes a compression mechanism 202 that outwardly biases a first end of the first support pole 200*a* relative to a second end of the first support pole 200*a*. In some embodiments, the compression mechanism 202 comprises a spring. In some embodiments, the compression mechanism comprises a plunger mechanism. In some embodiments, the compression mechanism comprises a ratchet mechanism. In some embodiments, the compression mechanism comprises a pneumatic system. In some embodiments, the compression mechanism comprises a piston. In some embodiments, a first end of the first support pole 200*a* includes a ball 37 of a ball-and socket joint constructed and arranged to mate with a socket 12 of a ball-and-socket joint positioned at an adapter clip 10*a*1 as described herein. In some embodiments, both a first end of the first support pole 200*a* and a second end of the first support pole 200*a* includes a ball 37 of a ball-and socket joint constructed and arranged to mate with a socket 12 of a ball-and-socket joint positioned at a corresponding first and second adapter clip 10*a*1, 10*a*2 as described herein.

In some embodiments, such as the one shown in FIG. 1, the system 1000 further comprises a first adapter 10*a*1, the first adapter 10*a*1 coupled to the first end of the first support pole 200*a* and side region of the first pole 100*a*. The first adapter 10*a*1 is constructed and arranged to position and secure the first support pole 200*a* to the first pole 100*a*. In some embodiments, such as the one in FIG. 1, the first end of the first support pole 200*a* is removably coupled to the first adapter 10*a*1. In some embodiments, such as the one in FIG. 1, the first end of the first support pole 200*a* is rotatably coupled to the first adapter 10*a*1. In some embodiments, the first end of the first support pole 200*a* is rotatably coupled to the first adapter 10*a*1 in such a manner that rotation is permitted about a first rotation axis and that rotation is limited or prevented about a second rotation axis.

In some embodiments, such as the one shown in FIG. 1, the system 1000 further comprises a second adapter 10*a*2, the second adapter 10*a*2 coupled to the second end of the first support pole 200*a* and the second pole 100*b*. The second adapter 10*a*2 is constructed and arranged to secure the first support pole 200*a* to the second pole 100*b*. In some embodiments, such as the one in FIG. 1, the second end of the first support pole 200*a* is removably coupled to the second adapter 10*a*2. In some embodiments, such as the one in FIG. 1, the second end of the first support pole 200*a* is rotatably coupled to the second adapter 10*a*2. In some embodiments, the second end of the first support pole 200*a* is rotatably coupled to the second adapter 10*a*2 in such a manner that rotation is permitted about a first rotation axis and that rotation is limited or prevented about a second rotation axis.

In some embodiments, such as the one shown in FIG. 1, the system 1000 further comprises a third adapter 10*b*1, the third adapter 10*b*1 coupled to the first end of the second support pole 200*b* and the first pole 100*a*. The third adapter 10*b*1 is constructed and arranged to secure the second support pole 200*b* to the first pole 100*a*. In some embodiments, such as the one in FIG. 1, the first end of the second support pole 200*b* is removably coupled to the third adapter 10*b*1. In some embodiments, such as the one in FIG. 1, the first end of the second support pole 200*b* is rotatably coupled to the third adapter 10*b*1. In some embodiments, the first end of the second support pole 200*b* is rotatably coupled to the third adapter 10*b*1 in such a manner that rotation is permitted about a first rotation axis and that rotation is limited or prevented about a second rotation axis.

In some embodiments, such as the one shown in FIG. 1, the system 1000 further comprises a fourth adapter 10*b*2, the fourth adapter 10*b*2 coupled to the second end of the second support pole 200*b* and the second pole 100*b*. The fourth adapter 10*b*2 is constructed and arranged to secure the second support pole 200*b* to the second pole 100*b*. In some embodiments, such as the one in FIG. 1, the second end of the second support pole 200*b* is removably coupled to the fourth adapter 10*b*2. In some embodiments, such as the one in FIG. 1, the second end of the second support pole 200*b* is rotatably coupled to the fourth adapter 10*b*2. In some embodiments, the second end of the second support pole 200*b* is rotatably coupled to the fourth adapter 10*b*2 in such a manner that rotation is permitted about a first rotation axis and that rotation is limited or prevented about a second rotation axis.

In this manner, the system 1000 provides for enhanced structural integrity to maintain the curtain poles 100*a*, 100*b*, and 100*c* in position between the floor and ceiling. The support poles 200*a*, 200*b* can operate as trusses in the system to provide for structural triangulation between the curtain poles 100*a*, 100*b*, 100*c*, rendering the system 1000 more resistant to stress, for example stress forces imparted by a change in differential air pressure at opposed regions of the curtain 101. Compression mechanisms 202 of the support poles 200*a*, 200*b* operate to relax rigidity in the system to provide "give" when needed, thereby allowing the system to accommodate rapid changes in applied forces.

In alternative embodiments, at least one of the ends of at least one of the support poles is integral with at least one adapter. In alternative embodiments, at least one of the ends of at least one of the support poles is fixed in arrangement with at least one adapter so they are not rotatably coupled.

In the embodiment shown in FIG. 1, the system 1000 comprises two support poles 200*a, b*. In alternative embodiments, the system 1000 comprises one support pole. In alternative embodiments, the system 1000 comprises more than two support poles.

In the embodiment shown in FIG. 1, the first support pole 200*a* extends between the first pole 100*a* and the second pole 100*b*. In alternative embodiments, the first support pole extends between the first pole 100*a* and the third pole 100*c*. In alternative embodiments, the first support pole extends between the second pole 100*b* and the third pole 100*c*.

In the embodiment shown in FIG. 1, the second support pole 200*b* extends between the first pole 100*a* and the second pole 100*b*. In alternative embodiments, the second support pole extends between the first pole 100*a* and the third pole 100*c*. In alternative embodiments, the second support pole extends between the second pole 100*b* and the third pole 100*c*.

In the embodiment shown in FIG. 1, the first support axis s1 is positioned transverse to the first pole axis p1 and the second pole axis p2. In alternative embodiments, the first support axis s1 is perpendicular with the first pole axis p1 and/or the second pole axis p2.

In the embodiment shown in FIG. 1, the second support axis s2 is positioned transverse to the first pole axis p1 and the second pole axis p2. In alternative embodiments, the second support axis s2 is perpendicular with the first pole axis p1 and/or the second pole axis p2. In various embodiments, the number poles and number of corresponding axes can be more than two.

In some embodiments, as described herein at least one of the support poles includes a length-adjustment mechanism such that the length can be adjusted. In some embodiments, at least one of the support poles is constructed such that the length is fixed.

In some embodiments, at least one of the support poles comprises a compression mechanism. In some embodiments, at least one of the support poles comprises an internal compression mechanism. In some embodiments, at least one of the support poles does not comprise a compression mechanism.

Figure 2:
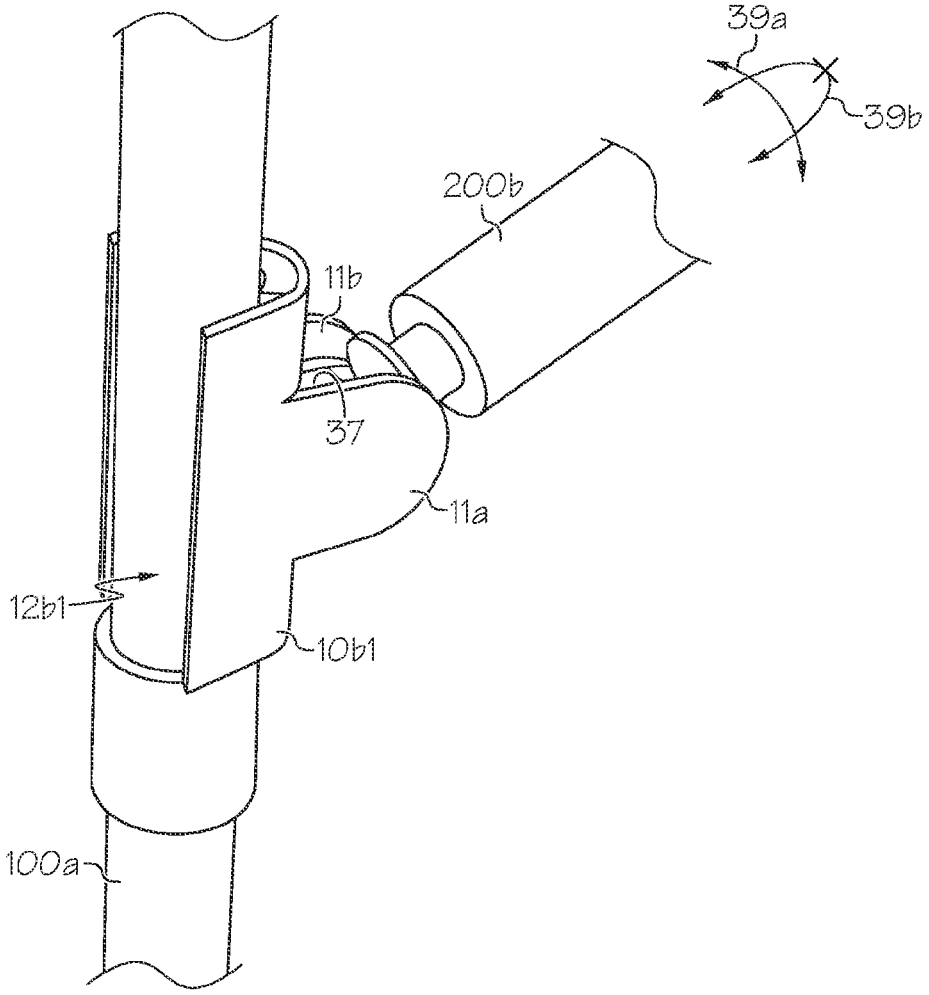
FIG. 2 is a perspective close-up view of the first end of the second support pole of the embodiment shown in FIG. 1, in accordance with aspects of inventive concepts herein.

FIG. 2 is a perspective close-up view of the first end of the second support pole 200*b* of the embodiment shown in FIG. 1, in accordance with aspects of inventive concepts herein. In some embodiments, such as the one shown in FIG. 2, at least one adapter 10*b*1 comprises an open end such that it is easy to couple the adapter to the pole. FIG. 2 shows the fourth adapter 10*b*1 of FIG. 1 and the adapter 10*b*1 comprises an open region 12*b*1 and does not extend around the first pole 100*a*.

In some embodiments, such as the one shown in FIG. 2, the adapter comprises at least one sidewall. In FIG. 2, first and second side walls 11*a*, 11*b* of the fourth adapter 10*b*1 are shown. In some embodiments, each sidewall 11*a*, 11*b* is constructed and arranged to limit the direction of rotation of the corresponding support pole. For example, in the embodiment shown in FIG. 2, the fourth adapter 10*b*1 comprises a first sidewall 11*a* and a second sidewall 11*b*. In this embodiment, the first sidewall 11*a* and the second sidewall 11*b* are constructed and arranged to allow the second support pole 200*b* to only rotate in the first plane. In the present embodiment the first and second sidewalls 11*a*. 11*b* flank a socket of the fourth adapter 10*cl* so that an inserted ball 37 at an end of the support pole 200*b* attached to the fourth adapter interfaces with and interacts with the sidewalls 11*a*, 11*b*. In this manner, the support pole 200*b* can freely rotate in a first degree of rotation 39*a* between the sidewalls 11*a*, 11*b*, while being limited from rotation in a second degree of rotation 39*b* by the sidewalls 11*a*, 11*b*.

Figure 3:
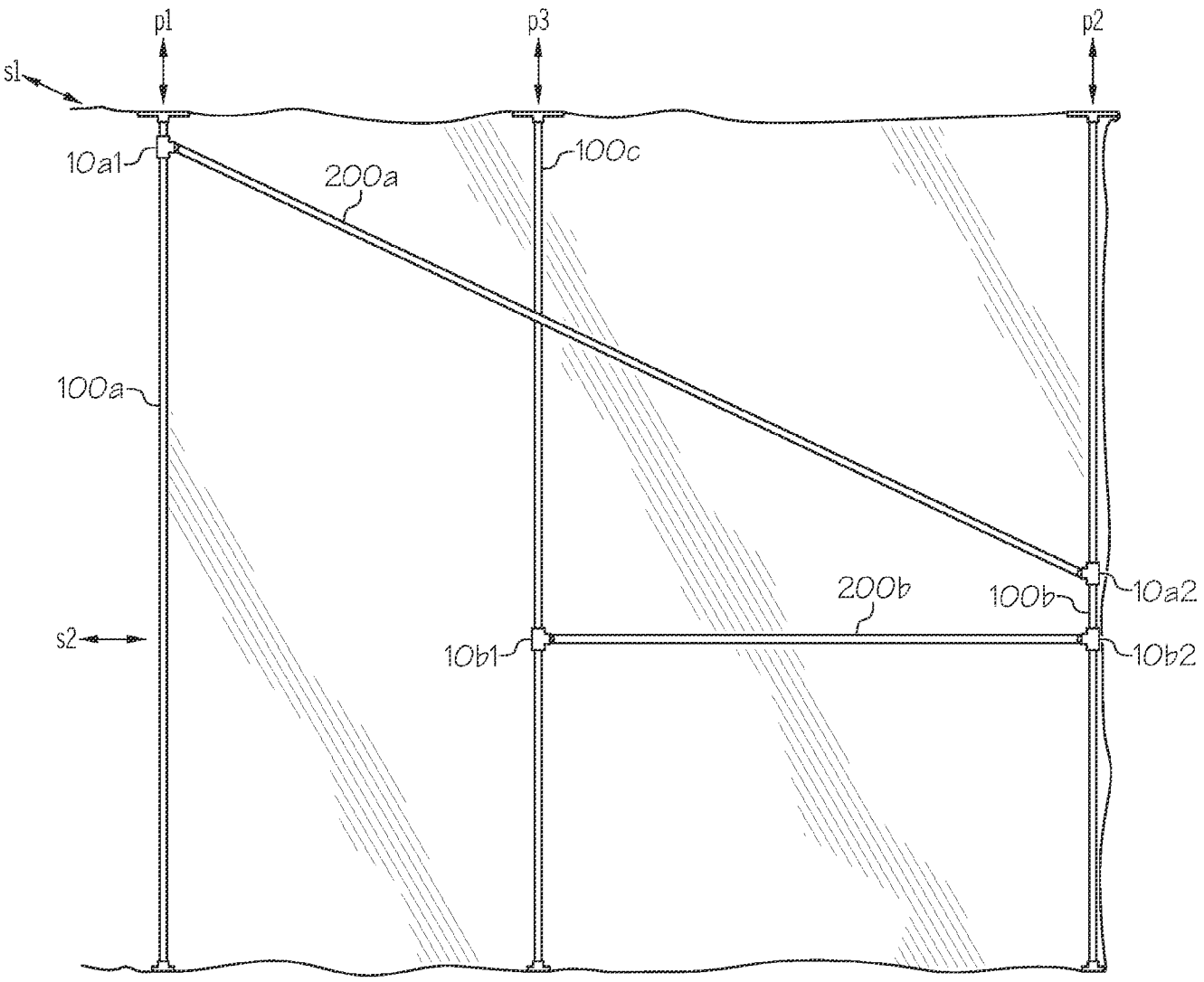
FIG. 3 is a front view of an embodiment of a support system, in accordance with aspects of inventive concepts herein.

FIG. 3 is a front view of an embodiment of a support system 1000, in accordance with aspects of inventive concepts herein. In the embodiment shown in FIG. 3, the first pole 100*a*, the second pole 100*b*, and the third pole 100*c* are arranged as they are in the embodiment of FIG. 1. In the embodiment shown in FIG. 3, the first support pole 200*a* is arranged as it is in the embodiment of FIG. 1.

In some embodiments, such as the one shown in FIG. 3, the system 1000 comprises a second support pole 200*b* elongated along a second support axis s2, the second support axis s2 being orthogonal to the first pole axis p1, the second pole axis p2, and the third pole axis p3, the second support pole 200*b* comprising a first end coupled to the third pole 100*c* and a second end coupled to the second pole 100*b*. In this embodiment, the third adapter 10*b*1 is coupled to the second support pole 200*b* and the third pole 100*c*. In this embodiment, the fourth adapter 10*b*2 is coupled to the second support pole 200*b* and the second pole 100*b*. In alternative embodiments, the second support pole 200*b* is coupled between the first pole 100*a* and the third pole 100*c*.

Figure 4:
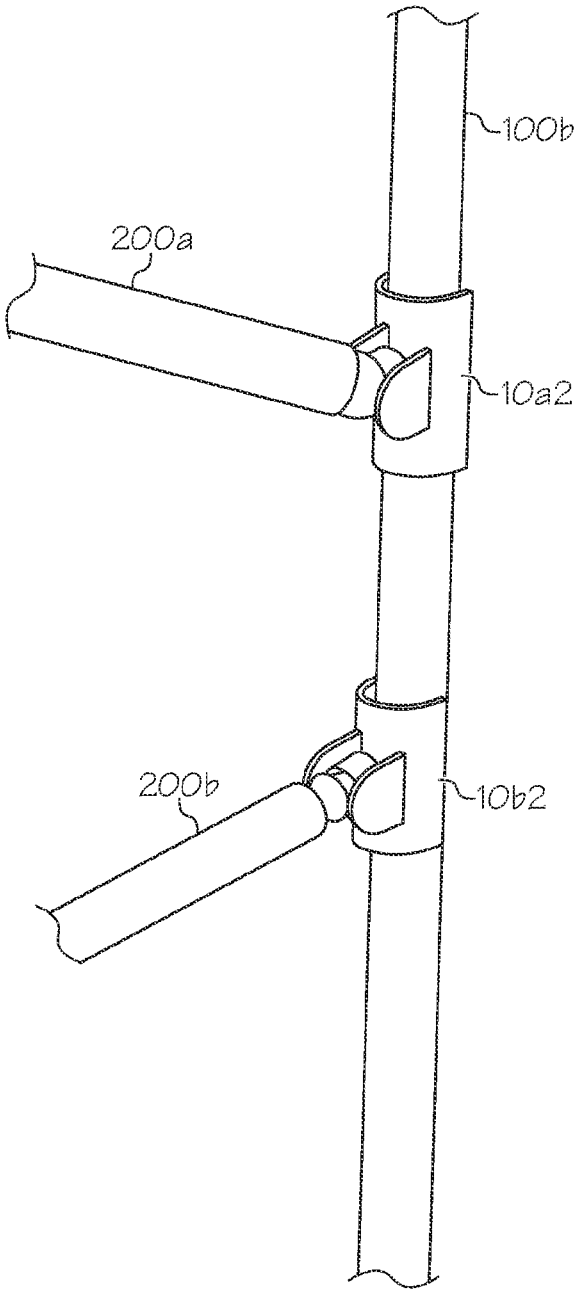
FIG. 4 is a perspective close-up view of the second end of the first support pole and the second support pole of the embodiment shown in FIG. 3, in accordance with aspects of inventive concepts herein.

FIG. 4 is a perspective close-up view of the second end of the first support pole 200*a* and the second support pole 200*b* of the embodiment shown in FIG. 3, in accordance with aspects of inventive concepts herein.

Figure 5A:
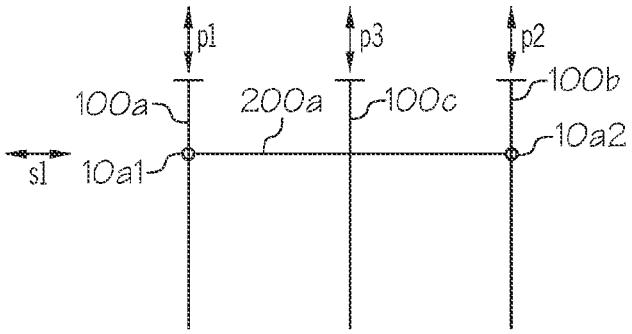
FIG. 5A is a front view of an embodiment of a support system, in accordance with aspects of inventive concepts herein.

FIG. 5A is a front view of an embodiment of a support system 1000, in accordance with aspects of inventive concepts herein. In some embodiments, such as the embodiment shown in FIG. 5A, the system 1000 comprises a first support pole 200*a* coupled between the first pole 100*a* and the second pole 100*b*. In some embodiments, such as the embodiment shown in FIG. 5A, the first support axis s1 is substantially orthogonal to the first pole axis p1 and the second pole axis p2.

Figure 5B:
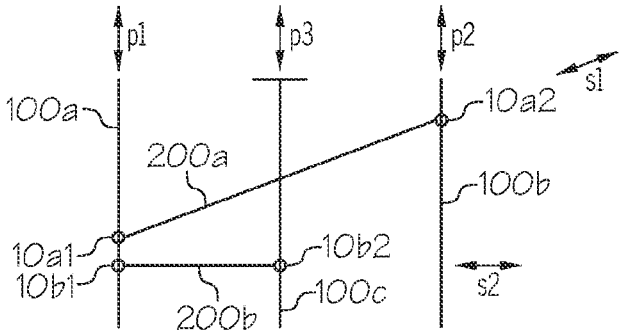
FIG. 5B is a front view of an embodiment of a support system, in accordance with aspects of inventive concepts herein.

FIG. 5B is a front view of an embodiment of a support system 1000, in accordance with aspects of inventive concepts herein. In some embodiments, such as the embodiment shown in FIG. 5B, the system 1000 comprises a first support pole 200*a* coupled between the first pole 100*a* and the second pole 100*b*. In some embodiments, such as the embodiment shown in FIG. 5B, the first support axis s1 is transverse to the first pole axis p1 and the second pole axis p2. In some embodiments, such as the embodiment shown in FIG. 5B, the system 1000 comprises a second support pole 200*b* coupled between the first pole 100*a* and the third pole 100*c*. In some embodiments, such as the embodiment shown in FIG. 5B, the second support axis s2 is orthogonal to the first pole axis p1 and the third pole axis p3.

Figure 5C:
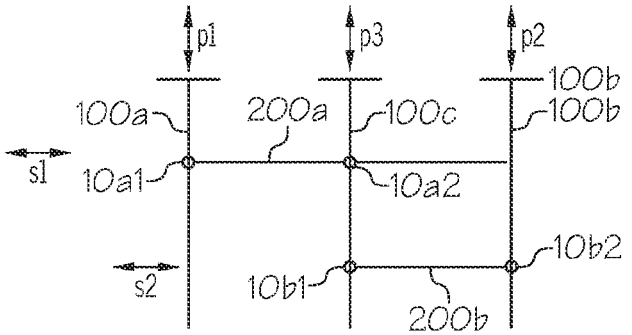
FIG. 5C is a front view of an embodiment of a support system, in accordance with aspects of inventive concepts herein.

FIG. 5C is a front view of an embodiment of a support system 1000, in accordance with aspects of inventive concepts herein. In some embodiments, such as the embodiment shown in FIG. 5C, the system 1000 comprises a first support pole 200*a* coupled between the first pole 100*a* and the third pole 100*c*. In some embodiments, such as the embodiment shown in FIG. 5C, the system 1000 comprises a second support pole 200*b* coupled between the second pole 100*b* and the third pole 100*c*. In some embodiments, such as the embodiment shown in FIG. 5C, the first support axis s1 is orthogonal to the first pole axis p1 and the second pole axis p2. In some embodiments, such as the embodiment shown in FIG. 5C, the second support axis s2 is orthogonal to the second pole axis p2 and the third pole axis p3.

Figure 5D:
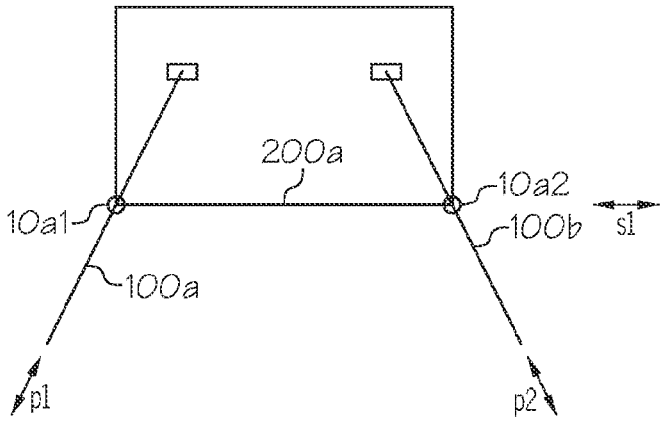
FIG. 5D is a perspective view of an embodiment of a support system, in accordance with aspects of inventive concepts herein.

FIG. 5D is a perspective view of an embodiment of a support system 1000, in accordance with aspects of inventive concepts herein. In some embodiments, such as the embodiment shown in FIG. 5D, the first pole 100*a* and the second pole 200*a* are oriented such that the first pole axis p1 and the second pole axis p2 are substantially parallel with a lower surface. In some embodiments, the first pole 100*a* and the second pole 200*a* are oriented such that the first pole axis p1 and the second pole axis p2 are transverse with a lower surface. In some embodiments, such as the embodiment shown in FIG. 5D, the system 1000 comprises a first support pole 200*a* coupled between the first pole 100*a* and the second pole 100*b*. In some embodiments, the first support axis s1 is orthogonal to the first pole axis p1 and the second pole axis p2.

Figure 5E:
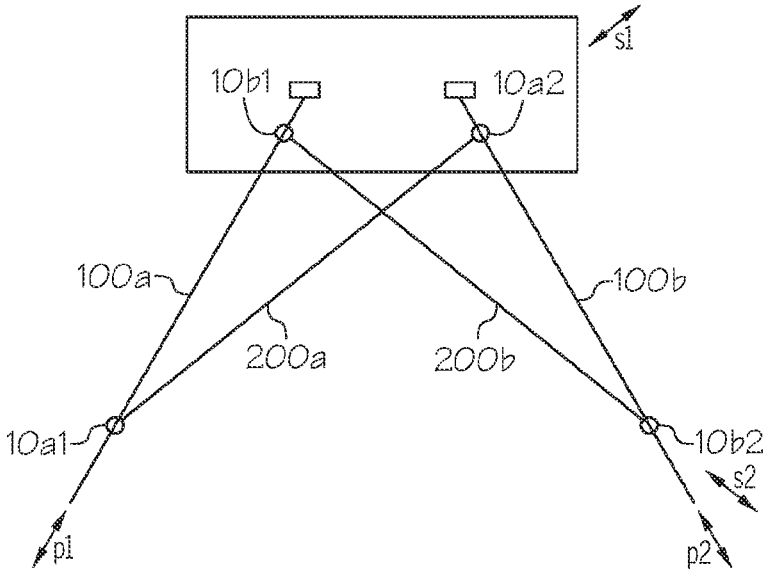
FIG. 5E is a perspective view of an embodiment of a support system, in accordance with aspects of inventive concepts herein.

FIG. 5E is a perspective view of an embodiment of a support system 1000, in accordance with aspects of inventive concepts herein. In some embodiments, such as the embodiment shown in FIG. 5D, the first pole 100*a* and the second pole 200*a* are oriented such that the first pole axis p1 and the second pole axis p2 are substantially parallel with a lower surface. In some embodiments, the first pole 100*a* and the second pole 200*a* are oriented such that the first pole axis p1 and the second pole axis p2 are transverse with a lower surface. In some embodiments, such as the embodiment shown in FIG. 5D, the system 1000 comprises a first support pole 200*a* and a second support pole 200*b* coupled between the first pole 100*a* and the second pole 100*b*. In some embodiments, the first support axis s1 is orthogonal to the first pole axis p1 and the second pole axis p2. In some embodiments, the second support axis s2 is orthogonal to the first pole axis p1 and the second pole axis p2.

Figure 6:
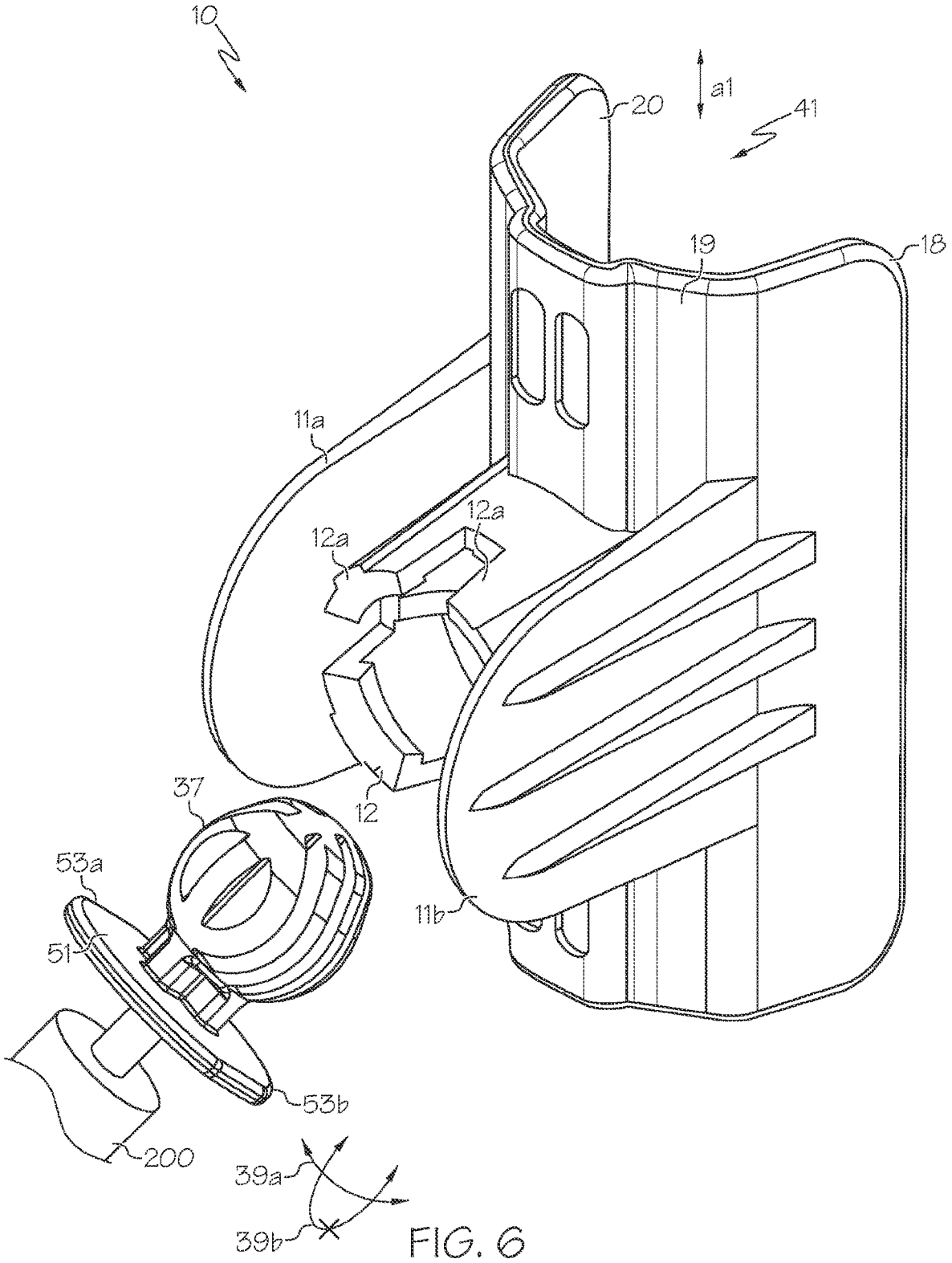
FIG. 6 is a perspective view of a top side of an embodiment of an adapter, in accordance with aspects of inventive concepts herein.

FIG. 6 is a perspective view of the top side of an embodiment of an adapter 10, in accordance with aspects of inventive concepts herein. In some embodiments, such as the one shown in FIG. 6, the adapter 10 comprises a base 18 that extends along an adapter axis a1. In some embodiments, such as the one shown in FIG. 6, the base is curved such that it can extend around at least a portion of a pole. In some embodiments, the base comprises an upper surface 19 and a lower surface 20. In some embodiments, the base includes a concave interface region 41 constructed and arranged to interface with a side portion of a curtain pole.

In some embodiments, such as the one shown in FIG. 6, the adapter 10 comprises at least one connection region 12 constructed and arranged for coupling the adapter to a support pole. In the embodiment shown in FIG. 6, the adapter 10 comprises one connection region 12. In alternative embodiments, the adapter 10 comprises more than one connection region 12, which allows the adapter to couple to more than one support pole.

In some embodiments, such as the embodiment shown in FIG. 6, the adapter couples with the support pole via a ball-and-socket joint. In some embodiments, such as the one shown in FIG. 6, the connection region 12 of the adapter 10 comprises a socket and the corresponding support pole comprises a ball. In alternative embodiments, the connection region comprises a ball and the support pole comprises a socket. In some embodiments, the socket comprises a plurality of socket fingers 12*a* that receive a ball in a snap-fit connection relationship. In some embodiments, the socket fingers 12*a* are elastically deformable so that they are constructed and arranged to temporarily deform about an inserted ball and snap back into place to retain the inserted ball 37.

In some embodiments, the adapter 10 comprises at least one sidewall extending from the upper surface and extending parallel to the adapter axis a1. In some embodiments, such as the one shown in FIG. 6, the adapter 10 comprises a first sidewall 11*a* and a second sidewall 11*b*, the first sidewall and the second sidewall being oriented parallel to each other. In some embodiments, such as the one shown in FIG. 6, the connection mechanism 12 is positioned between the two sidewalls 11*a*, 11*b*. In the present embodiment the first and second sidewalls 11*a*, 11*b* flank a socket of the adapter 10 so that an inserted ball 37 at an end of the support pole 200 interfaces with and interacts with the sidewalls 11*a*, 11*b*. In this manner, the support pole 200 can freely rotate in a first degree of rotation 39*a* between the sidewalls 11*a*, 11*b*, while being limited from rotation in a second degree of rotation 39*b* by the sidewalls 11*a*, 11*b*. In some embodiments, the ball 37 can be provided with a flange 51, the flange in turn including flats 53*a*, 53*b*. The flats 53*a*, 53*b* are dimensioned to be spaced apart by a distance that is slightly less than the spacing between the sidewalls 11*a*, 11*b*. In this manner, the flats 53*a*, 53*b* further resist inadvertent rotation of the support pole 200 in the second degree of rotation 39*b*, and in other degrees of rotation.

Figure 7:
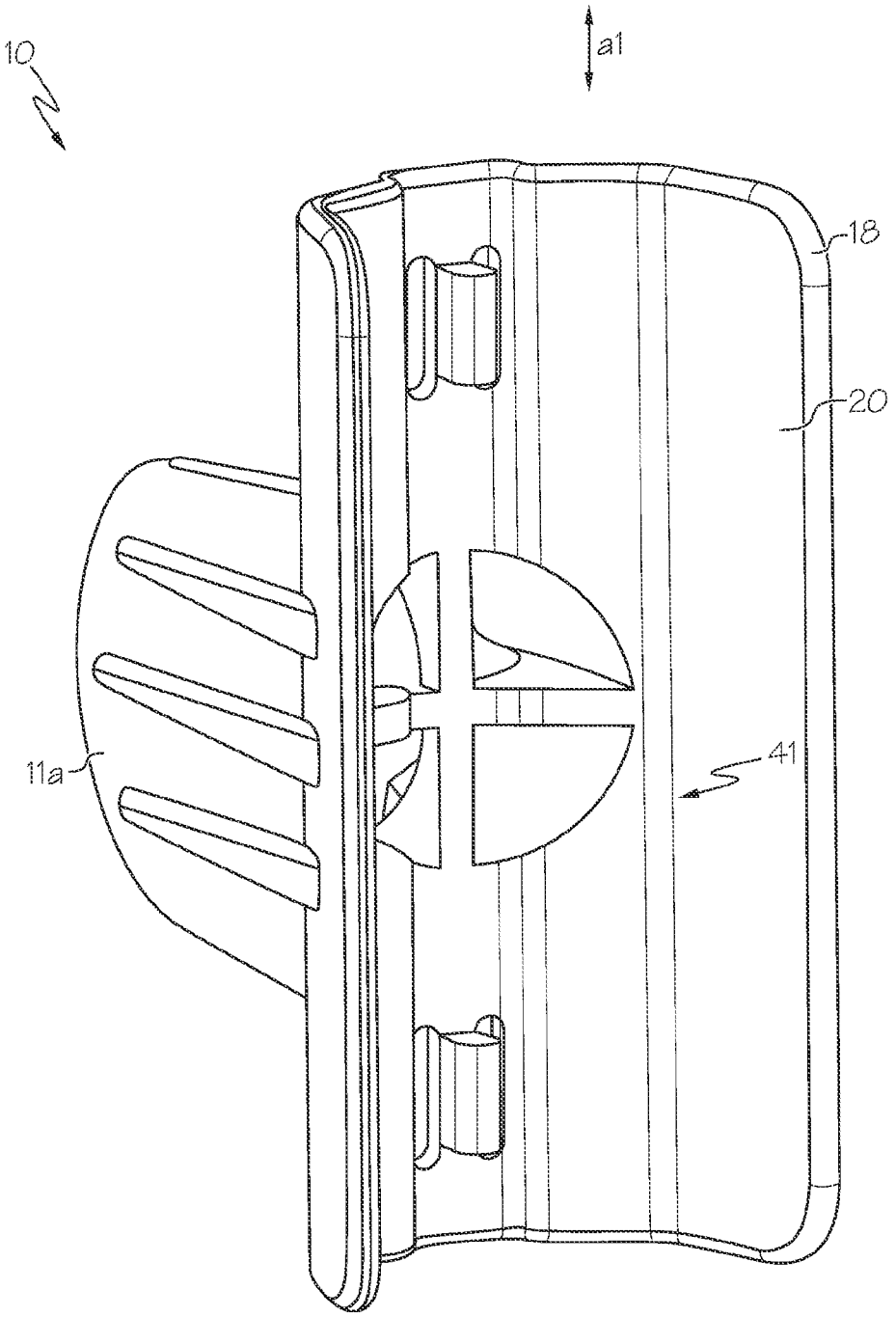
FIG. 7 is a perspective view of a bottom side of an embodiment of an adapter, in accordance with aspects of inventive concepts herein.

FIG. 7 is a perspective view of a bottom side of an embodiment of an adapter 10, in accordance with aspects of inventive concepts herein.

Figure 8:
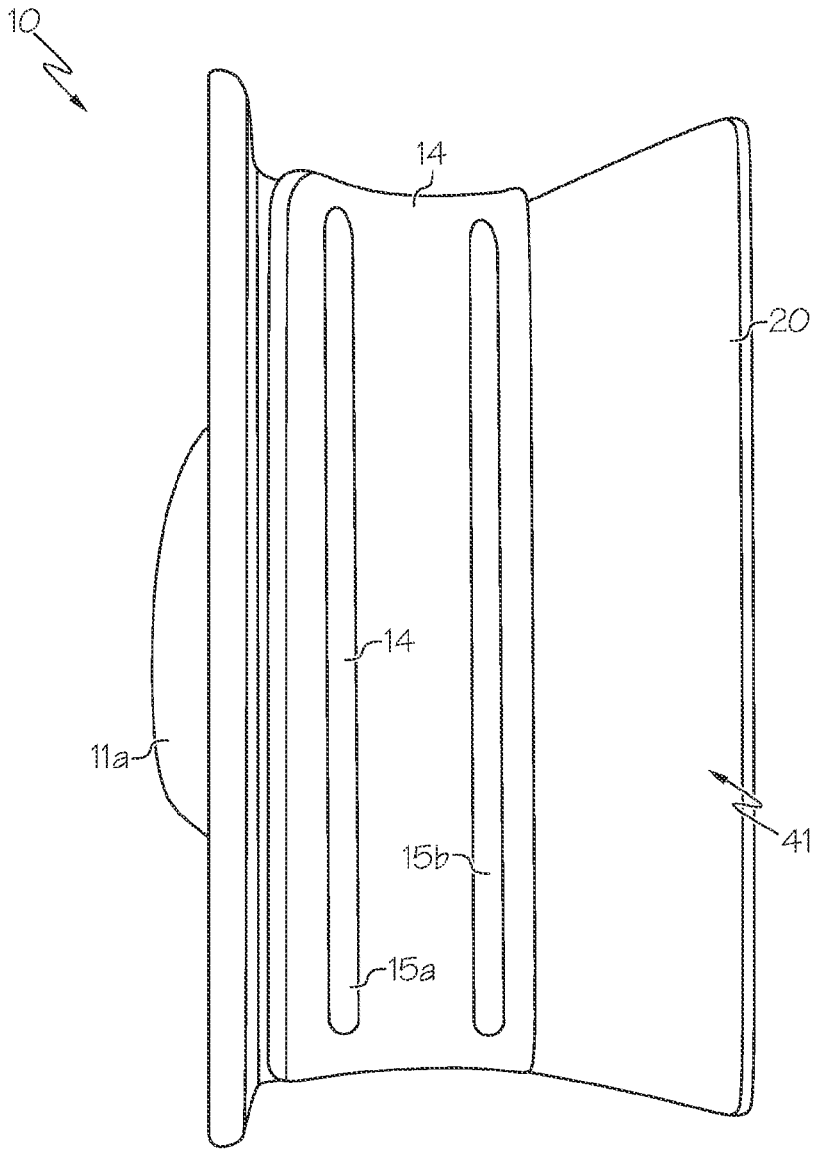
FIG. 8 is a perspective view of a bottom side of an embodiment of an adapter, in accordance with aspects of inventive concepts herein.

FIG. 8 is a perspective view of a bottom side of an embodiment of an adapter 10, in accordance with aspects of inventive concepts herein. In some embodiments, such as the embodiment shown in FIG. 8, the adapter 10 comprises a friction pad 14 constructed and arranged to create friction between the adapter 10 and a curtain pole. In this manner, the friction pad mitigates slipping of the adapter 10 relative to the curtain pole. In some embodiments, such as the embodiment shown in FIG. 8, the friction pad 14 comprises at least two raised regions 15*a, b* constructed and arranged to create friction between the adapter 10 and a curtain pole. The raised regions 15*a, b* extend in a direction along the adapter axis a1 and are spaced apart from each other. In this manner, the raised regions 15*a, b* provide for two defined regions of friction that are applicable to curtain poles of a range of diameters. In alternative embodiments, the friction pad 14 comprises a different number of raised regions.

Figure 9:
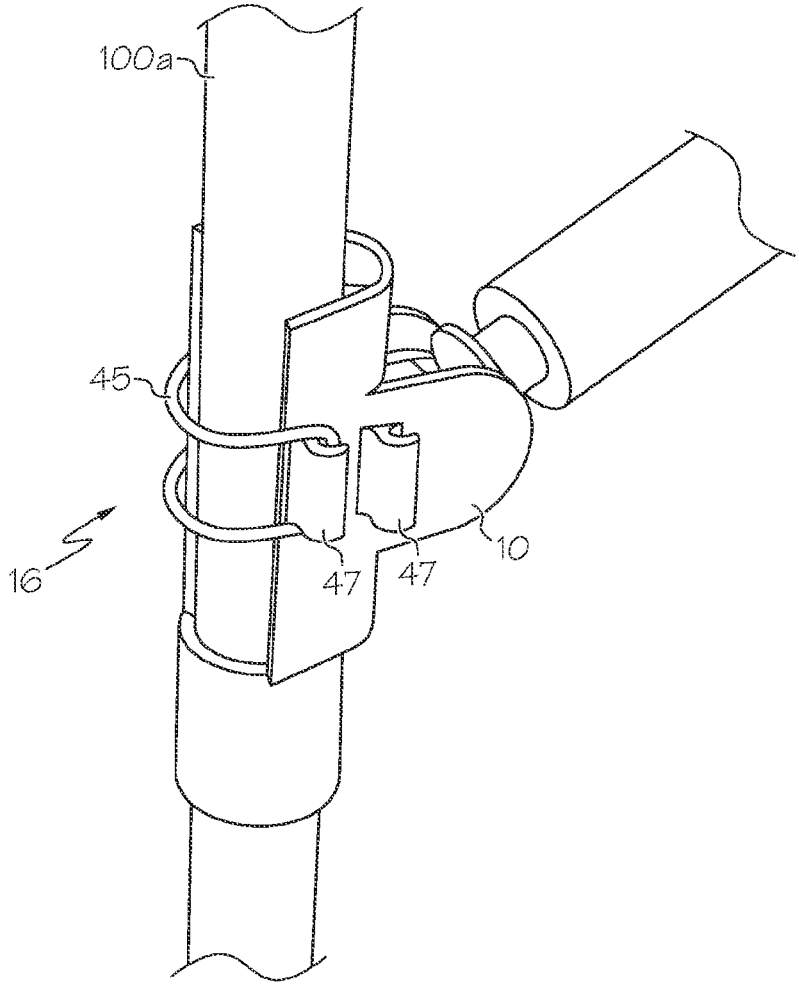
FIG. 9 is a perspective view of an embodiment of an adapter comprising a clamp locking mechanism, in accordance with aspects of inventive concepts herein.

FIG. 9 is a perspective view of an embodiment of an adapter comprising a clamp locking mechanism 16, in accordance with aspects of inventive concepts herein. In some embodiments, such as the embodiment shown in FIG. 9, the clamp locking mechanism is coupled to the adapter 10 and secures the adapter 10 to the curtain pole 100*a*. In some embodiments, the clamp locking mechanism 16 comprises a bail 45 and a plurality of seats 47 to accommodate curtain poles 100*a* of different diameters. In some embodiments, the seats 47 are integral with the adapter. In some embodiments, the bail 45 comprises an elastic band that is tensioned about the pole 100*a* for securing the adapter 10 to thew pole 100*a*.

Figure 10:
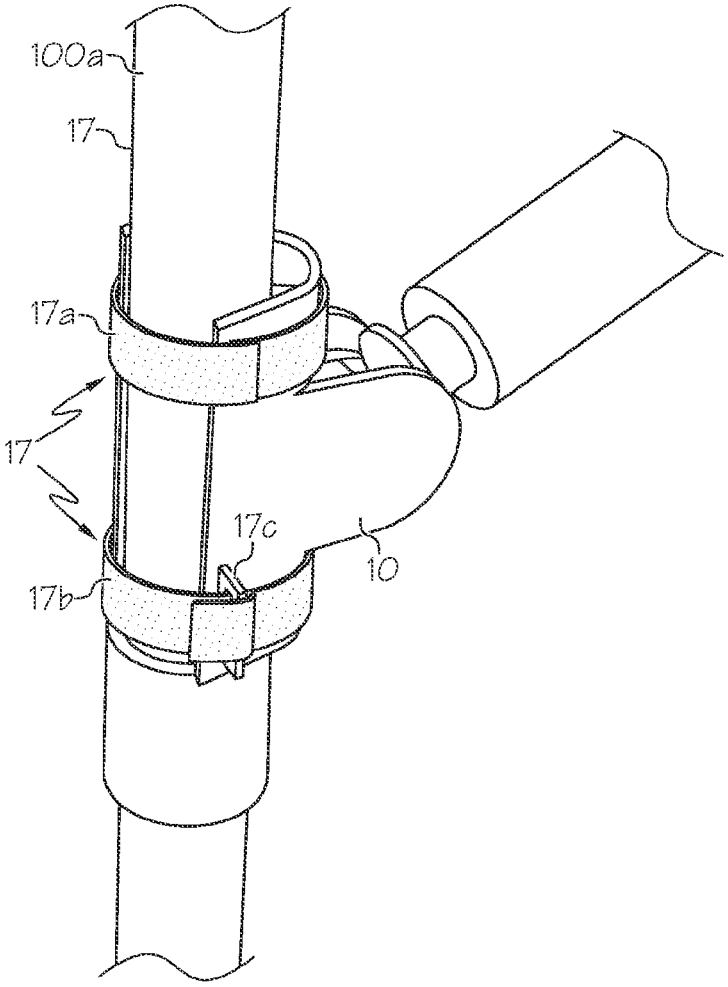
FIG. 10 is a perspective view of an embodiment of an adapter comprising a hook-and-loop locking mechanism, in accordance with aspects of inventive concepts herein.

FIG. 10 is a perspective view of an embodiment of an adapter comprising a hook-and-loop coupling mechanism 17, in accordance with aspects of inventive concepts herein. In some embodiments, such as the embodiment shown in FIG. 10, the hook-and-loop coupling mechanism is coupled about the adapter 10 and secures the adapter 10 to the curtain pole 100*a*. In a first embodiment 17*a* the hook-and-loop coupling mechanism 17 comprises a band that wraps about itself and has mating hooks and loops for securing an end of the band to a body of the band. In a second embodiment 17*b* (also shown in FIG. 10) the hook-and-loop coupling mechanism comprises a band with a return 17*c*. An end of the band passes through the return and is pulled back to double back on itself to secure the adapter to the pole 101. In some embodiments, the return 17*c* is integral with the adapter 10.

While inventive concepts have been particularly shown and described with references to embodiments thereof, it will be understood by those skilled in the art that various changes in form and detail may be made herein without departing from the spirit and scope of the inventive concepts as defined by the appended claims.

I claim:

1. A system, comprising:

a first pole elongated along a first axis;

a second pole elongated along a second axis, the second axis being substantially parallel with the first axis;

a first support pole elongated along a third axis, the third axis being transverse to the first axis and the second axis, the first support pole comprising a first end coupled to the first pole and a second end coupled to the second pole; and a first adapter coupled to the first end of the first support pole and the first pole, the first adapter comprising a base comprising an upper surface and a lower surface, wherein the base comprises:

a concave interface region on the lower surface constructed and arranged to interface with at least a portion of the first pole;

a first sidewall and a second sidewall extending from the upper surface; and at least one connection region on the upper surface between the first and second sidewalls constructed and arranged to couple to the first support pole.

2. The system of claim 1, wherein the first axis, the second axis, and the third axis extend in a first plane.

3. The system of claim 1, wherein the first end of the first support pole is removably coupled to the first adapter.

4. The system of claim 1, wherein the first end of the first support pole is coupled to the first adapter with a ball-and-socket joint.

5. The system of claim 1, wherein the first end of the first support pole is rotatably coupled to the first adapter.

6. The system of claim 5, wherein the first sidewall and the second sidewall constructed and arranged to limit rotation of the first support pole about a first axis of rotation.

7. The system of claim 1, wherein the first adapter comprises a friction pad constructed and arranged to create friction between the first adapter and the first pole.

8. The system of claim 7, wherein the friction pad comprises at least two raised regions constructed and arranged to create friction between the first adapter and the first pole.

9. The system of claim 1, wherein the first adapter comprises a hook-and-loop strap constructed and arranged to couple with the first pole.

10. The system of claim 1, wherein the first adapter comprises a clamp constructed and arranged to couple with the first pole.

11. The system of claim 1, wherein the first adapter comprises an open region.

12. The system of claim 1, wherein the first adapter extends around a portion of the first pole.

13. The system of claim 1, wherein the first adapter, comprising:

the base extending along a first axis, the first sidewall and the second sidewall extending from the upper surface and extending parallel to the first axis;

the connection region comprising at least one socket coupled to the upper surface, the at least one socket constructed and arranged to mate with a corresponding connector to form a ball-and-socket joint; and a friction pad coupled to the lower surface, the friction pad constructed and arranged to create friction between the first adapter and a pole.

14. The system of claim 13, wherein the friction pad comprises at least two raised regions constructed and arranged to create friction between the first adapter and the pole.

15. The system of claim 13, wherein the first sidewall and the second sidewall being spaced apart from each other.

16. The system of claim 15, wherein the socket is positioned between the first sidewall and the second sidewall.

17. The system of claim 1, further comprising a second adapter, the second adapter coupled to the second end of the first support pole and the second pole.

18. The system of claim 17, wherein the second end of the first support pole is removably coupled to the second adapter.

19. The system of claim 17, wherein the second end of the first support pole is coupled to the second adapter with a ball-and-socket joint.

20. The system of claim 17, wherein the second end of the first support pole is rotatably coupled to the second adapter.

21. The system of claim 20, wherein the second adapter comprises a first sidewall and a second sidewall, the first sidewall and the second sidewall constructed and arranged to limit rotation of the support pole about a first axis of rotation.

22. The system of claim 17, wherein the second adapter comprises a friction pad constructed and arranged to create friction between the second adapter and the second pole.

23. The system of claim 22, wherein the friction pad comprises at least two raised regions constructed and arranged to create friction between the second adapter and the second pole.

24. The system of claim 17, wherein the second adapter comprises a hook-and-loop strap constructed and arranged to couple with the second pole.

25. The system of claim 17, wherein the second adapter comprises a clamp constructed and arranged to couple with the second pole.

26. The system of claim 1, wherein the first support pole comprises a compression mechanism.

27. The system of claim 26, wherein the first support pole comprises an internal compression mechanism.

28. The system of claim 1, wherein the first pole is arranged between a floor and a ceiling.

29. The system of claim 1, further comprising a second support pole elongated along a fourth axis, the fourth axis being transverse to the first axis and the second axis, the second support pole comprising a first end coupled to the first pole and a second end coupled to the second pole.

30. The system of claim 29, wherein the first axis, the second axis, the third axis, and the fourth axis extend in a first plane.

31. The system of claim 30, further comprising a third adapter, the third adapter coupled to the first end of the second support pole and the first pole.

32. The system of claim 31, further comprising a fourth adapter, the fourth adapter coupled to the second end of the second support pole and the second pole.

33. The system of claim 29, wherein the second support pole is extendable.

34. The system of claim 1, wherein the first support pole is extendable.

35. A system, comprising:

a first pole elongated along a first axis;

a second pole elongated along a second axis, the second axis being substantially parallel with the first axis;

a first support pole elongated along a third axis, the third axis being transverse to the first axis and the second axis, the first support pole comprising a first end coupled to the first pole and a second end coupled to the second pole; and a first adapter, the first adapter coupled to the first end of the first support pole and the first pole, wherein the first adapter comprises a friction pad constructed and arranged to create friction between the first adapter and the first pole and wherein the friction pad comprises at least two raised regions constructed and arranged to create friction between the first adapter and the first pole.

36. A system, comprising:

a first pole elongated along a first axis;

a second pole elongated along a second axis, the second axis being substantially parallel with the first axis;

a first support pole elongated along a third axis, the third axis being transverse to the first axis and the second axis, the first support pole comprising a first end coupled to the first pole and a second end coupled to the second pole; and a first adapter, the first adapter coupled to the first end of the first support pole and the first pole, wherein the first adapter, comprising:

a curved base extending along a first axis, the curved base comprising an upper surface and a lower surface; the curved base constructed to extend around at least a portion of a pole, at least one sidewall extending from the upper surface and extending parallel to the first axis; and at least one socket coupled to the upper surface, the at least one socket constructed and arranged to mate with a corresponding connector to form a ball-and-socket joint.

37. The system of claim 36, wherein the first adapter further comprises a friction pad coupled to the lower surface, the friction pad constructed and arranged to create friction between the first adapter and a pole.

38. A system, comprising:

a first pole elongated along a first axis;

a second pole elongated along a second axis, the second axis being substantially parallel with the first axis;

a first support pole elongated along a third axis, the third axis being transverse to the first axis and the second axis, the first support pole comprising a first end coupled to the first pole and a second end coupled to the second pole;

a first adapter, the first adapter coupled to the first end of the first support pole and the first pole; and a second adapter, the second adapter coupled to the second end of the first support pole and the second pole, wherein the second adapter comprises a friction pad constructed and arranged to create friction between the second adapter and the second pole and wherein the friction pad comprises at least two raised regions constructed and arranged to create friction between the second adapter and the second pole.

* * * * *